US009340013B2

(12) United States Patent
Kitaoka et al.

(10) Patent No.: US 9,340,013 B2
(45) Date of Patent: May 17, 2016

(54) IMAGE FORMING APPARATUS AND HEAD DRIVE CONTROL METHOD

(71) Applicants: Naoko Kitaoka, Kanagawa (JP); Satomi Araki, Kanagawa (JP)

(72) Inventors: Naoko Kitaoka, Kanagawa (JP); Satomi Araki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/831,202

(22) Filed: Aug. 20, 2015

(65) Prior Publication Data

US 2016/0075132 A1 Mar. 17, 2016

(30) Foreign Application Priority Data

Sep. 17, 2014 (JP) ..... 2014-188753

(51) Int. Cl.
*B41J 29/38* (2006.01)
*B41J 2/045* (2006.01)

(52) U.S. Cl.
CPC ..... *B41J 2/04588* (2013.01)

(58) Field of Classification Search
CPC ..... B41J 2/04581; B41J 2/04588; B41J 2/04593; B41J 2/04573
See application file for complete search history.

(56) References Cited

U.S. PATENT DOCUMENTS 5,023,625 A * 6/1991 Bares ..... B41J 2/055 347/48
5,359,350 A * 10/1994 Nakano ..... B41J 2/04541 347/10
6,106,092 A * 8/2000 Norigoe ..... B41J 2/04581 347/11
6,290,315 B1 * 9/2001 Sayama ..... 347/10
8,491,076 B2 * 7/2013 Hoisington ..... B41J 2/04508 347/10
2006/0061609 A1 * 3/2006 Okuda ..... B41J 2/04573 347/10
2007/0273719 A1 * 11/2007 Yamashita ..... B41J 2/04588 347/11
2011/0063351 A1 * 3/2011 Kitaoka ..... B41J 2/04593 347/11
2014/0240384 A1 * 8/2014 Yokomaku ..... 347/11

FOREIGN PATENT DOCUMENTS

| | | |
|---|---|---|
| JP | 64-056556 | 3/1989 |
| JP | 4-083648 | 3/1992 |
| JP | 2003-053957 | 2/2003 |
| JP | 2005-280273 | 10/2005 |
| JP | 2007-168216 | 7/2007 |
| JP | 2007-313757 | 12/2007 |
| JP | 2012-116040 | 6/2012 |

* cited by examiner

*Primary Examiner* — Stephen Meier
*Assistant Examiner* — John P Zimmermann
(74) *Attorney, Agent, or Firm* — Cooper & Dunham LLP

(57) ABSTRACT

An image forming apparatus includes a liquid discharge head including plural nozzles to discharge droplets; a plurality of individual liquid chambers; a pressure generator, and a head drive controller. A meniscus oscillation generated in the individual liquid chamber applied with the pressure by the pressure generator has a phase reverse to a phase of a meniscus oscillation generated in the adjacent individual liquid chamber not applied with the pressure by the pressure generator, the common drive waveform generated by the head drive controller includes a common discharge pulse used for forming droplets having at least two sizes and an noncommon discharge pulse used for forming one of the droplets having two sizes, and a pulse interval between the common discharge pulse and the noncommon discharge pulse located right before the common discharge pulse is a time area having a phase reverse to resonance.

6 Claims, 16 Drawing Sheets

IMAGE FORMING APPARATUS AND HEAD DRIVE CONTROL METHOD

CROSS-REFERENCE TO RELATED APPLICATIONS

This patent application is based on and claims priority pursuant to 35 U.S.C. §119 to Japanese Patent Application No. 2014-188753, filed on Sep. 17, 2014, in the Japan Patent Office, the entire disclosure of which is hereby incorporated by reference herein.

BACKGROUND

1. Technical Field

The present invention relates to an image forming apparatus and a head drive control method.

2. Description of the Related Art

An image forming apparatus using a liquid discharge head to discharge a droplet as a record head, e.g., an inkjet recorder is known.

To form a high-resolution image, the nozzle density of the liquid discharge head increases such that a pitch between the adjacent nozzles becomes small, and a partition width between each of liquid chambers through which a nozzle passes tends to become thin.

Therefore when a droplet is discharged from a nozzle, drop speed changes depending on whether a nozzle adjacent to that nozzle is a nozzle discharging a droplet, or the nozzle which does not discharge a droplet, and the adjacency crosstalk, i.e., shifting in landing position of the droplet, tends to occur.

SUMMARY

There is known a method of reducing influence of the adjacent crosstalk by differentiating drive cycles between the adjacent nozzles. However, the present inventors have discovered that, when the drive cycles are differentiated between the adjacent nozzles, drive frequency and print speed decrease, and landing position of the droplet is shifted, resulting in increase of pitches between dots.

Accordingly, one object of the present invention is to provide an image forming apparatus capable of reducing shift in landing position of a droplet to improve image quality.

Another object of the present invention is to provide a head drive control method of reducing shift in landing position of a droplet to improve image quality.

These objects and other objects of the present invention, either individually or collectively, have been satisfied by the discovery of an image forming apparatus, including a liquid discharge head including plural nozzles to discharge droplets; a plurality of individual liquid chambers provided for respective ones of the plural nozzles, each liquid chamber being communicated with each nozzle; a pressure generator to generate a pressure pressurizing a liquid in each one of the individual liquid chambers, and a head drive controller to chronologically in one drive cycle, generate a common drive waveform including plural discharge pulses for causing droplet discharge, select one or more discharge pulses out of the plural discharge pulses, and apply the selected discharge pulses to the pressure generator to discharge at least two droplets having different sizes, wherein a meniscus oscillation generated in the individual liquid chamber applied with the pressure by the pressure generator has a phase reverse to a phase of a meniscus oscillation generated in the adjacent individual liquid chamber not applied with the pressure by the pressure generator, the common drive waveform generated by the head drive controller includes a common discharge pulse used for forming droplets having at least two sizes and an noncommon discharge pulse used for forming one of the droplets having two sizes, and a pulse interval between the common discharge pulse and the noncommon discharge pulse located right before the common discharge pulse is a time area having a phase reverse to resonance.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
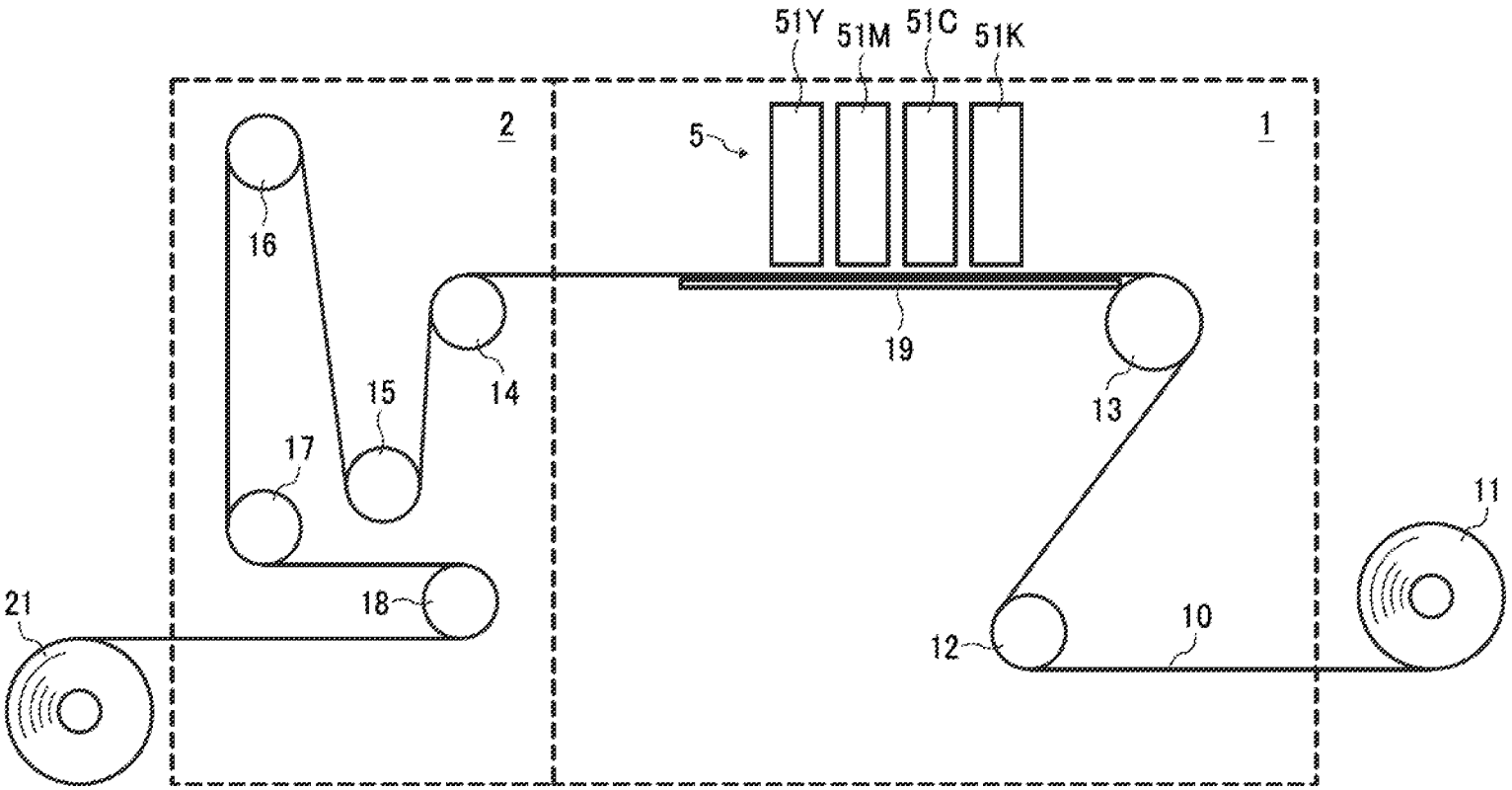
FIG. 1 is a schematic view illustrating an embodiment of the image forming apparatus of the present invention.

The present invention provides an image forming apparatus reducing shift of landing position of a droplet to improve image quality.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

First, an embodiment of the present invention is explained with reference to FIG. 1. FIG. 1 is a schematic view illustrating an embodiment of the image forming apparatus of the present invention.

The image forming apparatus is a full-line inkjet recorder including a recorder body 1 and an exit unit 2 to obtain drying time in parallel.

The image forming apparatus conveys, with conveyance rollers 12 to 18, a recording medium 10 that is a continuous paper unwound from an unwinding roller 11 to a winding roller 21 that winds the recording medium 10. The recording medium for use in the image forming apparatus may be a sheet-shaped recording medium.

The recording medium 10, in between a first conveyance roller 13 and a second conveyance roller 14, is conveyed on a conveyance guide member 19 while facing an image forming unit 5. An image is formed on the recording medium 10 with liquid droplets discharged from the image forming unit 5.

The image forming unit 5 includes, for example, four full-line recording heads 51K, 51C, 51M, and 51Y corresponding to four colors. The four full-line recording heads 51K, 51C, 51M, and 51Y are provided, for example, from an upstream side of a conveyance direction of the recording medium 10. The four full-line recording heads 51K, 51C, 51M, and 51Y discharge, with respect to the conveyed recording medium 10, liquid droplets of black (K), cyan (C), magenta (M), and yellow (Y), respectively. The generic term "recording heads 51" is used hereinafter when no distinction is made with respect to colors. It is to be noted that colors and number of colors are not limited to the above-described example.

Figure 2:
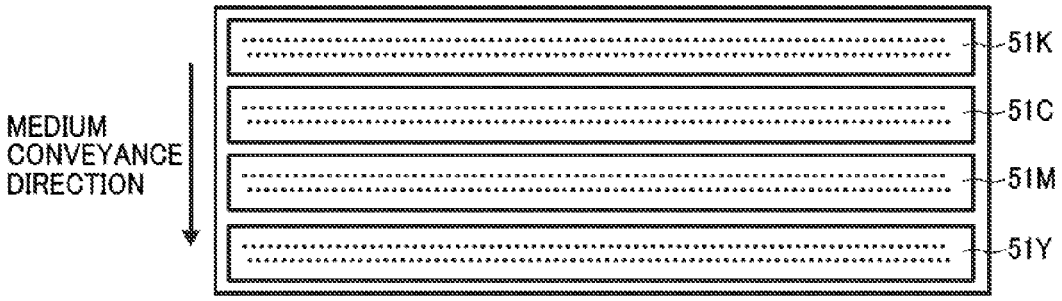
FIG. 2 is a plane view illustrating an example of a record head of the apparatus.
Figure 3:
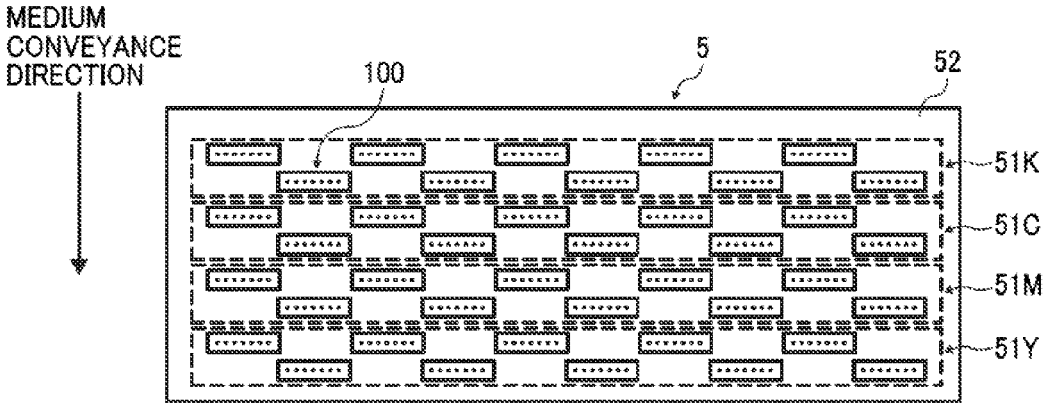
FIG. 3 is a plane view illustrating another example of the record head.

As shown in FIG. 2, each of the recording heads 51 may be a single head corresponding to a full-line recording head. Further, each of the recording heads 51 may also be a head array with multiple short length heads 100, arranged with respect to a width of the recording medium 10, provided in a zigzagging arrangement on a base member 52 to form a full-line recording head as shown in FIG. 3. With respect to the above-described example of FIG. 1, each of the recording heads 51 is configured of a liquid discharging head unit including a liquid discharging head and a head tank to supply liquid to the liquid discharging head. It is to be noted that a configuration of each of the recording heads 51 is not limited to the above-described example. Each of the recording heads 51 may also be configured of a liquid discharging head singly.

Figure 4:
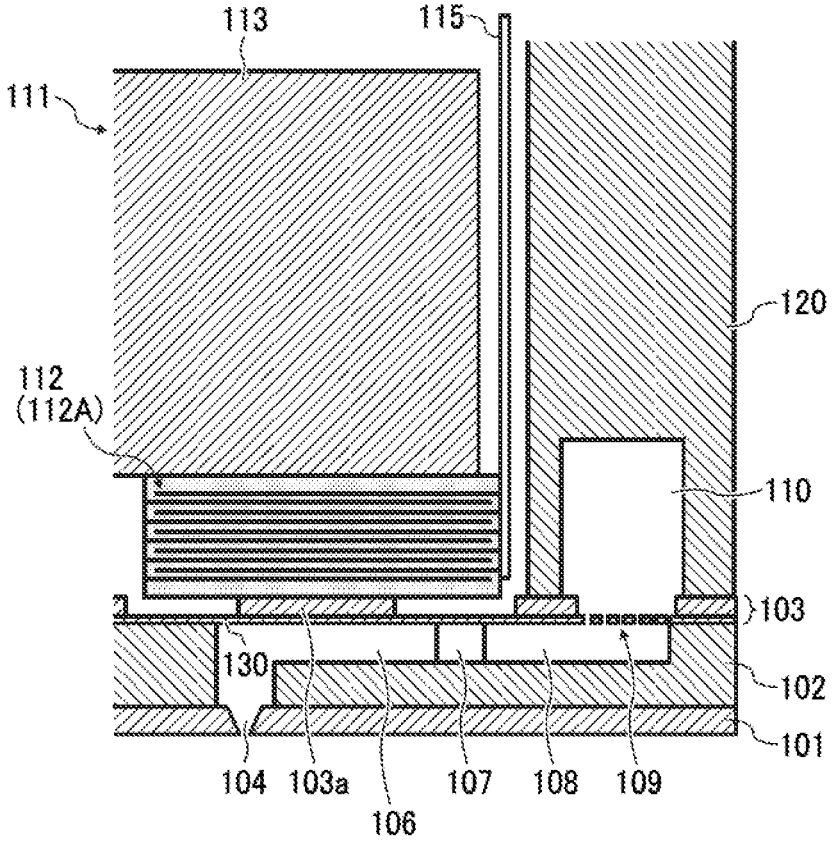
FIG. 4 is a cross-sectional view illustrating a direction orthogonal to a nozzle array direction (longitudinal direction of the liquid chamber) of an example of a liquid discharge head (head tip) constituting the record head.

The following is a description of an example of a configuration of the liquid discharging head (i.e., head chip) of the recording heads 51 with reference to FIG. 4 and FIG. 5. FIG. 4 is a cross-sectional view illustrating a direction orthogonal to a nozzle array direction (longitudinal direction of the liquid chamber) of an example of a liquid discharge head (head tip) constituting the record head, and FIG. 5 is a cross-sectional view illustrating the nozzle array direction (short hand direction of the liquid chamber). The liquid discharging head includes a nozzle plate 101, a channel plate 102 (i.e., liquid chamber substrate), and an oscillation plate member 103 that are joined. The liquid discharging head further includes a piezoelectric actuator 111 to displace the oscillation plate member 103, and a frame member 120 serving as a common channel member.

With the above-described configuration, individual liquid chambers 106 (hereinafter may also be referred to as pressure chambers or pressure applying chambers) communicated to multiple nozzles 104 that discharge the liquid droplets are formed. Further, a liquid supplying channel 107, that also serves as a fluid resistance member, to supply a liquid to the individual liquid chambers 106 and a liquid introduction member 108 communicated to the liquid supplying channel 107 are formed. Adjacent individual liquid chambers 106 are separated by partitions 106A along the direction of the nozzle array.

The individual liquid chamber 106 is formed by closing both sides of a through hole 102*a* of the channel plate 102 having the shape of a plate with the nozzle plate 101 and the oscillation plate member 103.

The liquid is supplied to the individual liquid chambers 106 from a common liquid chamber 110 serving as a common channel of the frame member 120 via a filter member 109 formed at the oscillation plate member 103, the liquid introduction member 108, and the liquid supplying channel 107.

The piezoelectric actuator 111 is provided opposite to the individual liquid chambers 106 via oscillation areas 130, which are deformable, of the oscillation plate member 103 constituting walls of the individual liquid chambers 106.

The piezoelectric actuator 111 includes multiple laminated piezoelectric members 112 joined to a base member 113. More specifically, with respect to a single laminated piezoelectric member 112, the single laminated piezoelectric member 112 is formed into a comb teeth shape, with a predetermined interval, having a desired number of column shaped piezoelectric elements 112A (hereinafter may also be referred to as piezoelectric columns) by half-cut dicing to form grooves.

Figure 5A:
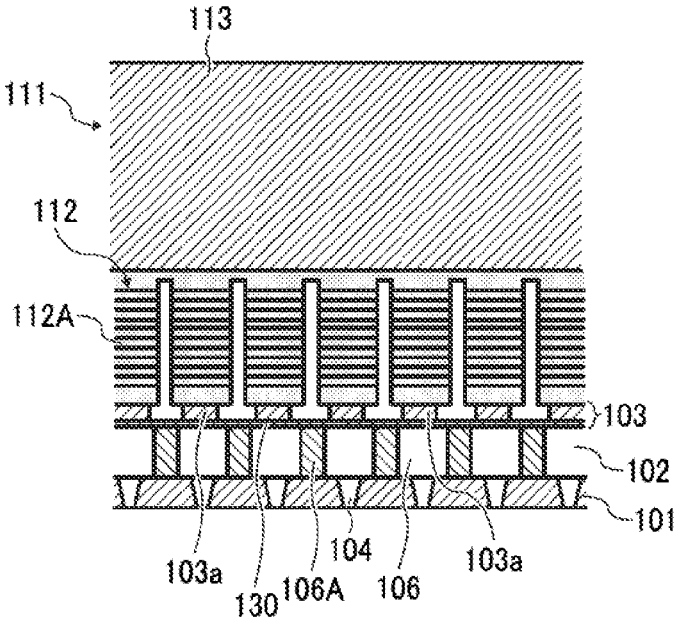
FIGS. 5A and 5B are cross-sectional views illustrating the nozzle array direction (short hand direction of the liquid chamber)

The piezoelectric columns 112A are joined to island-shaped protruding portions 103*a* formed at the oscillation areas 130 of the oscillation plate member 103. As FIG. 5A shows, the adjacent piezoelectric columns 112A are sequentially joined to the oscillation areas 130 of the individual liquid chambers 106 as a normal pitch structure.

Figure 5B:
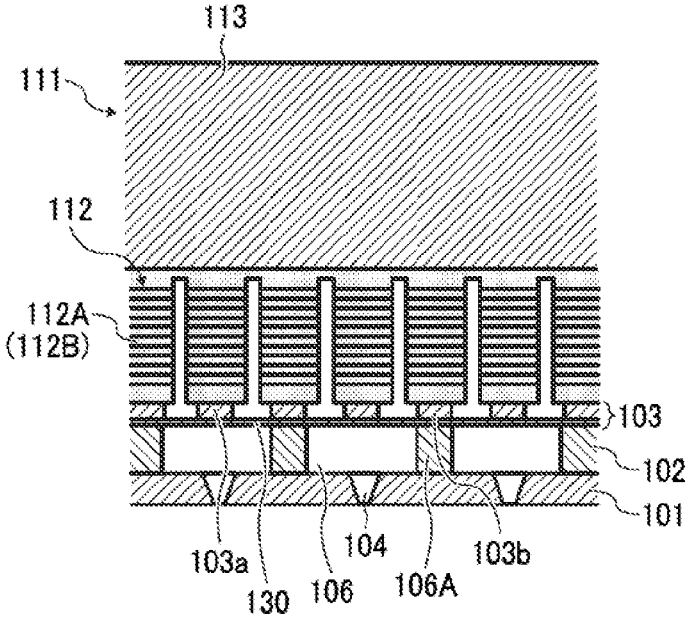

As FIG. 5B shows, one of the adjacent piezoelectric columns 112A as a column 112B may be joined to a projection 103*b* correspondent to the partition 106A between the individual liquid chambers as a bi-pitch structure.

Namely, the bi-pitch (double pitch) structure locating a column correspondent to the individual liquid chamber reduces adjacent crosstalks. However, the bi-pitch needs to locate piezoelectric columns at a density twice as much as that of the nozzle pitch, modification at very high preciseness, and becomes short of power because the piezoelectric column has shorter width.

The normal pitch structure locating no column correspondent to partitions between the individual liquid chambers reduces problems of modification preciseness by half, but largely increases adjacent crosstalk. The present invention largely decreases speed reduction (shifted landing) due to adjacent stroke, and downsizes, highly integrates and simplifies without deterioration of image quality.

The piezoelectric member 112 is formed of alternately laminating a piezoelectric layer and an internal electrode. More specifically, each of the internal electrodes are drawn out to an end surface of the piezoelectric member 112 to be provided with external electrodes, and a flexible printed circuit 115 (hereinafter referred to as FPC) serving as a flexible wiring substrate having flexibility is connected to the external electrodes to apply drive signals to the external electrodes of the piezoelectric column 112A.

The frame member 120 is formed with injection molding employing, for example, an epoxy based resin or a thermoplastic resin such as polyphenylene sulfide. The common liquid chamber 110 that is supplied with the liquid from the head tank or from a liquid cartridge is formed in the frame member 120.

When the voltage applied to the piezoelectric columns 112A is increased, the piezoelectric columns 112A extend in a laminated direction. Accordingly, the oscillation areas 130 of the oscillation plate member 103 deform in a direction of the multiple nozzles 104, and volume of the individual liquid chambers 106 decrease. Thus, pressure is applied to the liquid in the individual liquid chambers 106. Accordingly, the multiple nozzles 104 discharge (i.e., spray) the liquid droplets of the liquid.

When the voltage applied to the piezoelectric columns 112A are returned to the reference potential, the oscillation areas 130 of the oscillation plate member 103 return to the initial positions, and a negative pressure is generated due to expansion of the individual liquid chambers 106. Accordingly, the liquid within the individual liquid chambers 106 is replenished from the common liquid chamber 110 via the liquid supplying channel 107. After a vibration of a meniscus surface of the multiple nozzles 104 attenuates and stabilizes, transition to an operation for next discharge of the liquid droplets is conducted.

It is to be noted that drive methods of the above-described liquid discharging head is not limited to the above-described example (i.e., pull-push-discharge). For example, the drive method may also be pull-discharge or push-discharge depending on application of a drive waveform.

Figure 6:
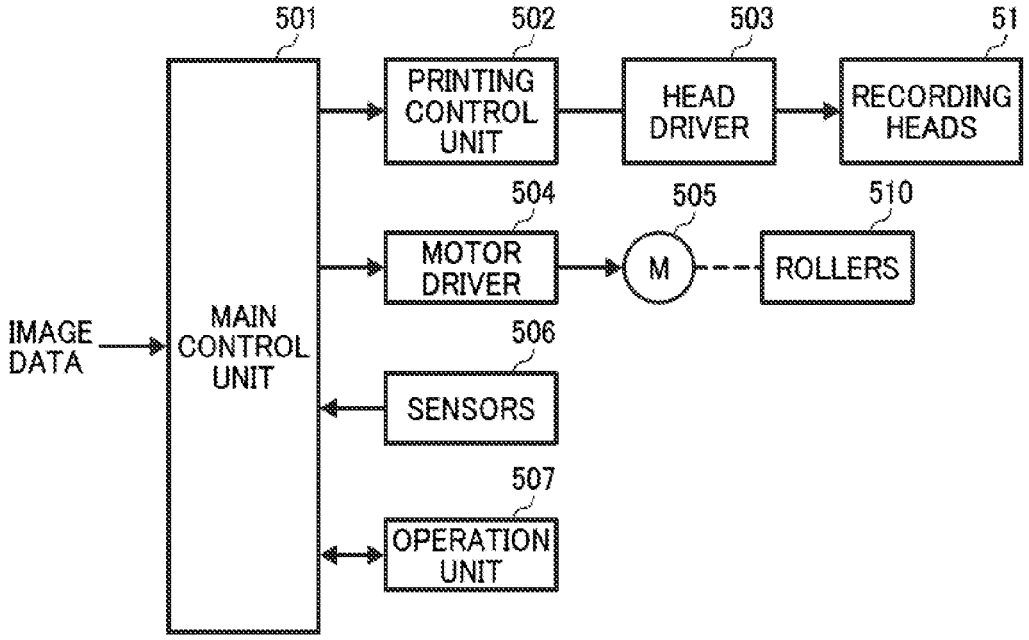
FIG. 6 is a block diagram of a controller of the imaging forming apparatus.

Next, an outline of the controller of the image forming apparatus is explained with reference to FIG. 6. FIG. 6 is a block diagram of a controller of the imaging forming apparatus.

The controller includes a main controller 501 (hereinafter may also be referred to as system controller) implemented by a microcomputer that controls entire operation of the image forming apparatus and also serves as a head drive controller according to an embodiment of the present invention, an image memory, and a communication interface. The main controller 501 transfers print data (i.e., image data) to a print controller 502 to form an image on a recording medium based on the image data and various command information transferred from an external information processing device (i.e., host).

The print controller 502 serially transfers the image data received from the main controller 501 to a head driver 503. Further, the print controller 502 outputs to the head driver 503, a latch signal or a transfer clock for transfer of the image data and determination of transfer, a control signal, and a drive signal formed of one drive pulse or multiple drive pulses. The print controller 502 includes a drive waveform generating unit 701 implemented by a digital-to-analog (hereinafter referred to as D/A) converter that applies D/A conversion of pattern data of a common drive waveform Vcom stored in a read only memory (hereinafter referred to as ROM), a voltage amplifier, and an electric current amplifier.

The head driver 503 selects, based on the image data corresponding to one of the recording heads 51 that is serially inputted, a drive pulse of the common drive waveform Vcom applied by the print controller 502. Then, the head driver 503 applies the selected drive pulse to the multiple laminated piezoelectric members 112 serving as pressure generators and causes the multiple nozzles 104 to discharge the liquid droplets. By selecting all or a portion of the drive pulse of the common drive waveform Vcom or by selecting all or a portion of a waveform element of the drive pulse, liquid droplets of different size can be selectively discharged to form dots of different size. For example, large liquid droplets, medium liquid droplets, and small liquid droplets can be selectively discharged.

The main controller 501 controls, via a motor driver 504 and drive motors 505, various rollers 510 that include the unwinding roller 11, conveyance rollers 12 to 18, and the winding roller 21.

A detection signal from sensors 506 formed of various sensors is inputted to the main controller 501. Input-output of various information and display information transactions are conducted between the main controller 501 and an operation unit 507.

Figure 7:
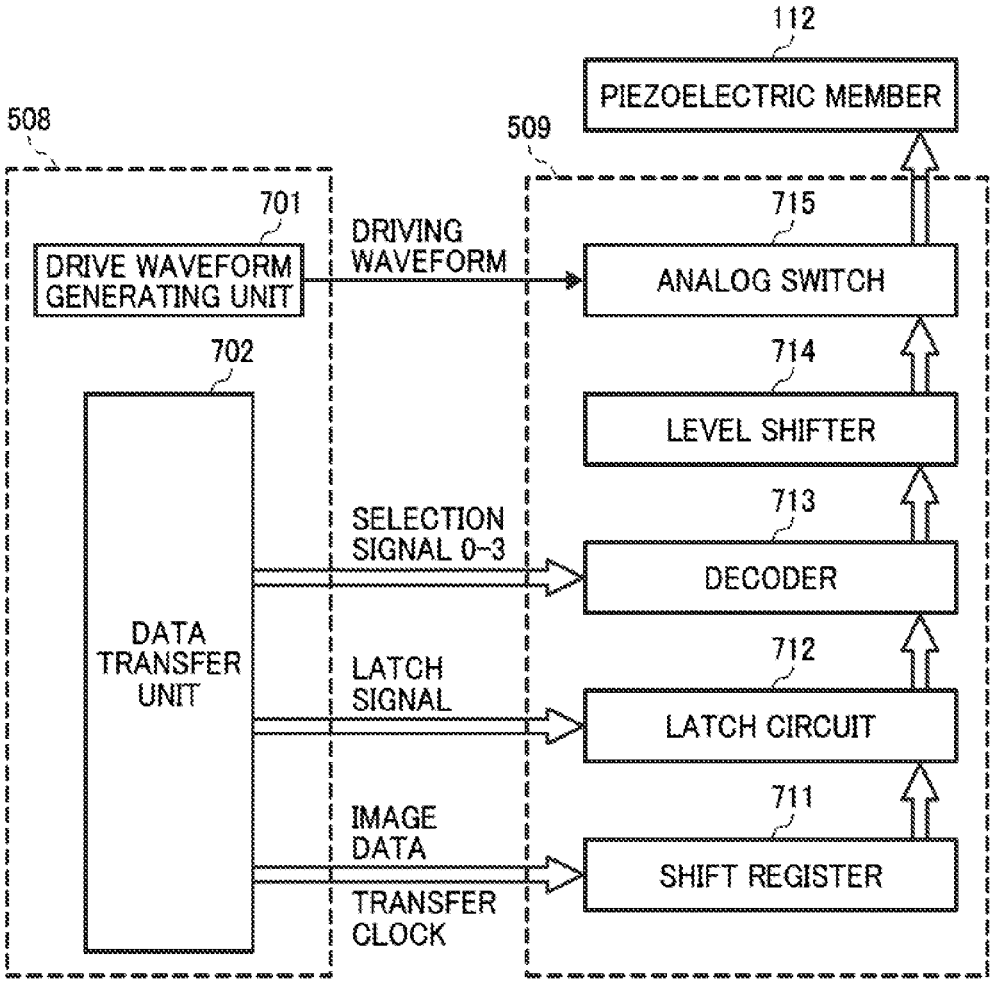
FIG. 7 is a block diagram of an example of a print controller and a head driver.

The following is a description of an example of the print controller 502 and the head driver 503 with reference to FIG. 7.

The print controller 502 includes the drive waveform generating unit 701 to generate and output the common drive waveform Vcom, and a data transfer unit 702. The data transfer unit 702 outputs two bits of the image data (i.e., gradation signal 0,1) according to a print image, a clock signal, the latch signal (hereinafter may be referred to as LAT), and selection signals 0 to 7 that select the drive pulse of the common drive waveform Vcom.

From the drive waveform generating unit 701, the common drive waveform Vcom is generated and outputted. Within one print cycle (i.e., one drive cycle) of the common drive waveform Vcom, multiple drive pulses (hereinafter may also be referred to as discharging pulses) are arranged in time series that make the multiple nozzles 104 discharge the liquid droplets.

The selection signals 0 to 3 are signals that instruct, with respect to each of the liquid droplets, turning one or off of an analog switch 715 serving as a switch unit of the head driver 503. Details of the analog switch 715 are described later. Transition to a state of H level (i.e., ON) is conducted with the drive pulse or the waveform element that is selected accordant with the print cycle of the drive waveform Vcom, and a transition to a state of L level (i.e., OFF) is conducted at no selection.

The head driver 503 includes a shift register 711, a latch circuit 712, a decoder 713, a level shifter 714, and the analog switch 715.

The transfer clock (hereinafter may also be referred to as shift clock) and the serially imputed image data (i.e., gradation data: two bits/one channel (one nozzle)) are inputted to the shift register 711 from the data transfer unit 702. The latch circuit 712 latches each register value of the shift register 711 according to the latch signal. The decoder 713 decodes the gradation data and the selection signals 0 to 7, and outputs a result of decoding. The level shifter 714 converts a logic level voltage signal of the decoder 713 to a level at which the analog switch 715 is operable. The analog switch 715 turns ON/OFF (i.e., opens/closes) according to an output of the decoder 713 applied via the level shifter 714.

The analog switch 715 is connected to selected electrodes (i.e., individual electrodes) of each of the multiple laminated piezoelectric members 112. Accordingly, the common drive waveform Vcom from the drive waveform generating unit 701 is inputted to the analog switch 715. According to the serially transferred image data (i.e., gradation data) and the result of decoding the selection signals 0 to 7 from the decoder 713, the analog switch 715 is turned ON. Thus, the drive pulse or the waveform element of the common drive waveform Vcom passes through (more specifically, selected) the analog switch 715 and is applied to each of the piezoelectric column 112A.

Next, a relation between the liquid chamber and the adjacent crosstalk is explained. The same numbers in FIGS. 4 and 5 are used as for head components for convenience of explanation.

In the present invention, a part formed of one nozzle, an individual liquid chamber and a pressure generator is called a "channel". The individual liquid chamber where the pressure generator is driven to discharge a droplet from the nozzle is called a "drive individual liquid chamber", and the nozzle discharging a droplet and components relevant thereto are called a "drive channel". The individual liquid chamber where the pressure generator is not driven not to discharge a droplet from the nozzle is called a "non-drive individual liquid chamber", and the nozzle not discharging a droplet and components relevant thereto are called a "non-drive channel". Driving the pressure generator to discharge a droplet from the nozzle equals "driving the nozzle", "driving the (individual) liquid chamber" or "driving the channel".

An example of the liquid chamber structure and a relation between meniscus oscillations of the adjacent channels are explained with reference to FIGS. 8 and 9.

Figure 8:
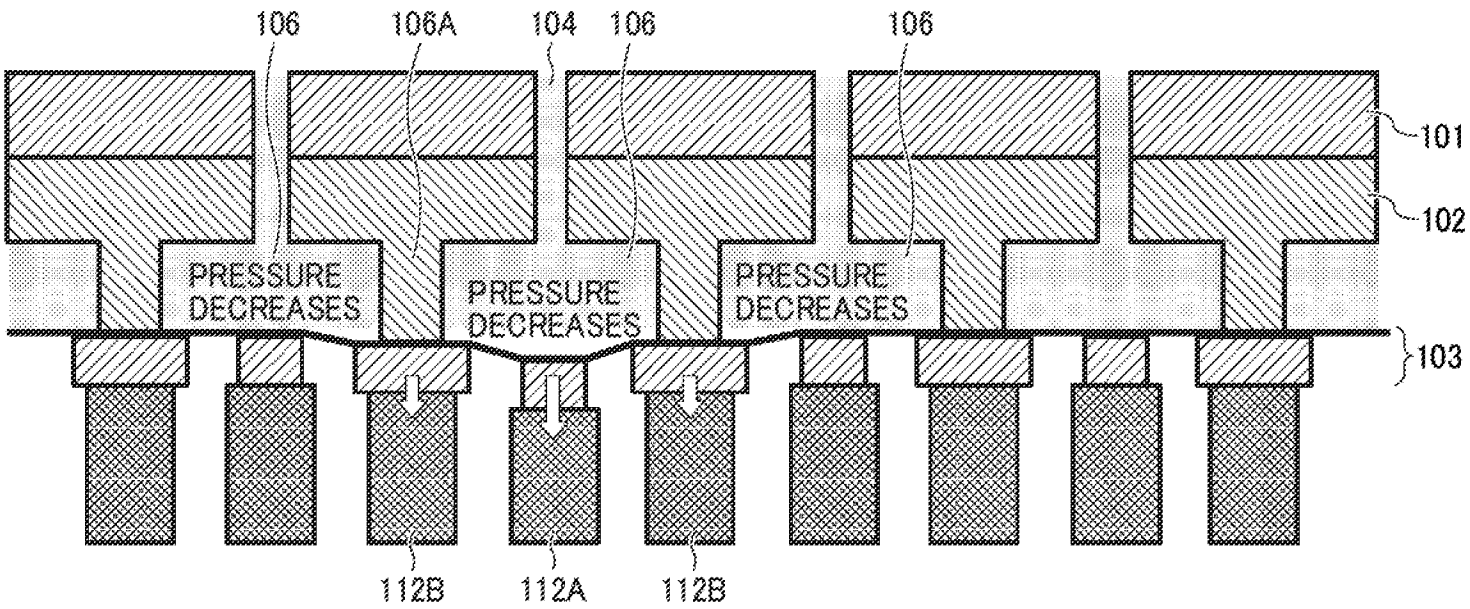
FIG. 8 is a schematic view illustrating a relation of an example of the liquid chamber structure and the adjacent crosstalk.

The liquid chamber structure in FIG. 8 uses a member including a projective individual channel 106 as a channel plate 102, formed by half etching a silicone substrate or a metallic member. A piezoelectric column 112A is located with a high pitch structure.

In the liquid chamber structure, jointed sides of the channel plate 102 and a nozzle plate 101 have so high stiffness that the channel plate 102 is difficult to deform.

Therefore, a crosstalk oscillation due to deformation of a partition 106A and deformation or tension of an oscillation plate member 103 is transmitted to the adjacent individual liquid chambers 106.

Figure 9:
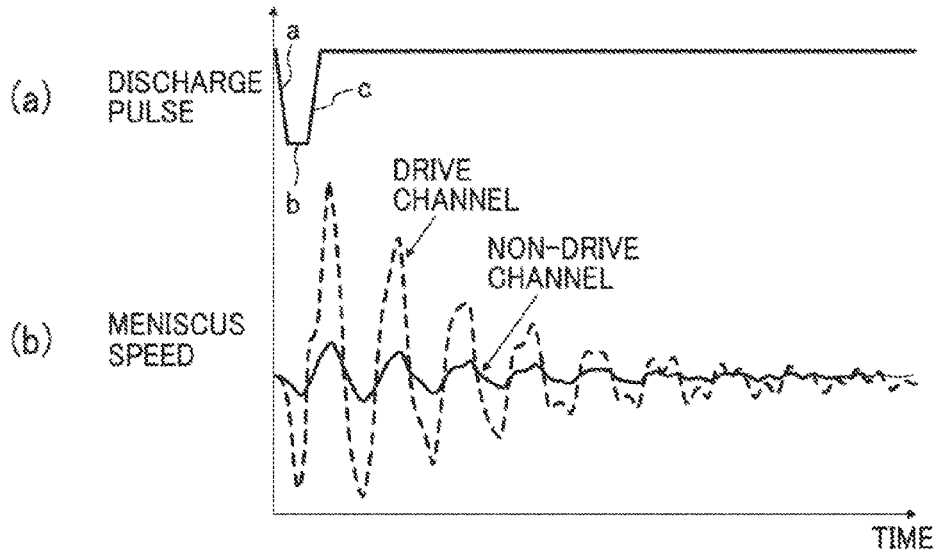
FIG. 9 is a schematic diagram for explaining a meniscus speed of a non-drive channel adjacent to a drive channel in the liquid chamber structure in FIG. 8.

Therefore, as FIG. 9 (*a*) shows, when a drive (discharge) pulse is applied to a pressure generator of a drive individual liquid chamber 106, as FIG. 8 shows, it inflates and a pressure therein decreases (lowers), and an adjacent non-drive individual liquid chamber 106 inflates and a pressure therein decreases as well. When the drive individual liquid chamber 106 contracts and a pressure therein increases, a pressure in the non-drive individual liquid chamber 106 decreases as well.

As FIG. 9 shows, the discharge pulse basically includes an inflation waveform element (drawing waveform element) a falling down from a standard potential to inflate the individual liquid chamber 106, a holding waveform element b holding a potential keeping the individual liquid chamber 106 inflated and a contraction waveform element (pushing waveform element) c standing up from the holding potential to transition the state of the individual liquid chamber 106 from being inflated to being contracted.

Therefore, as FIG. 9 (*b*) shows, a meniscus oscillation having the same phase as that of a meniscus oscillation generated in the drive individual liquid chamber 106 (drive channel) is generated in the non-drive individual liquid chamber 106 (non-drive channel). FIG. 9 (*b*) shows in meniscus speed.

Next, another example of the liquid chamber structure and a relation between meniscus oscillations of the adjacent channels are explained with reference to FIGS. 10 and 11.

Figure 10:
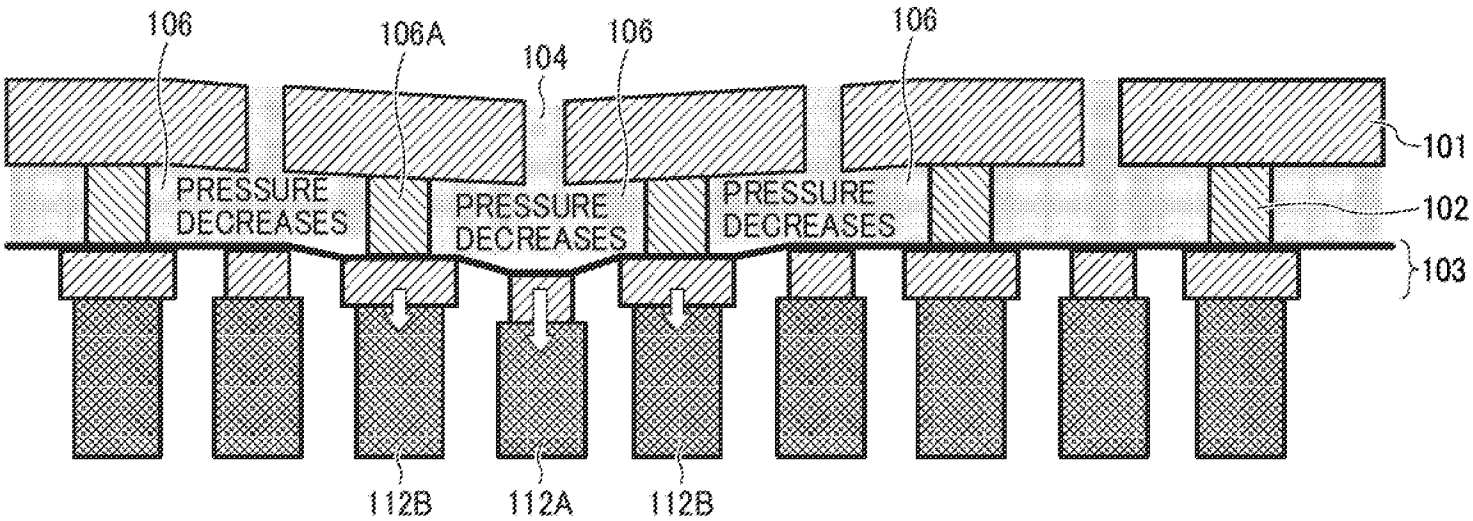
FIG. 10 is a schematic view illustrating a relation of another example of the liquid chamber structure and the adjacent crosstalk.

As the liquid chamber structure in FIG. 10 forms a through-hole on a channel plate 102 to form an individual liquid chamber 106, the channel plate 102 is easy to deform with the nozzle plate 101.

Figure 11:
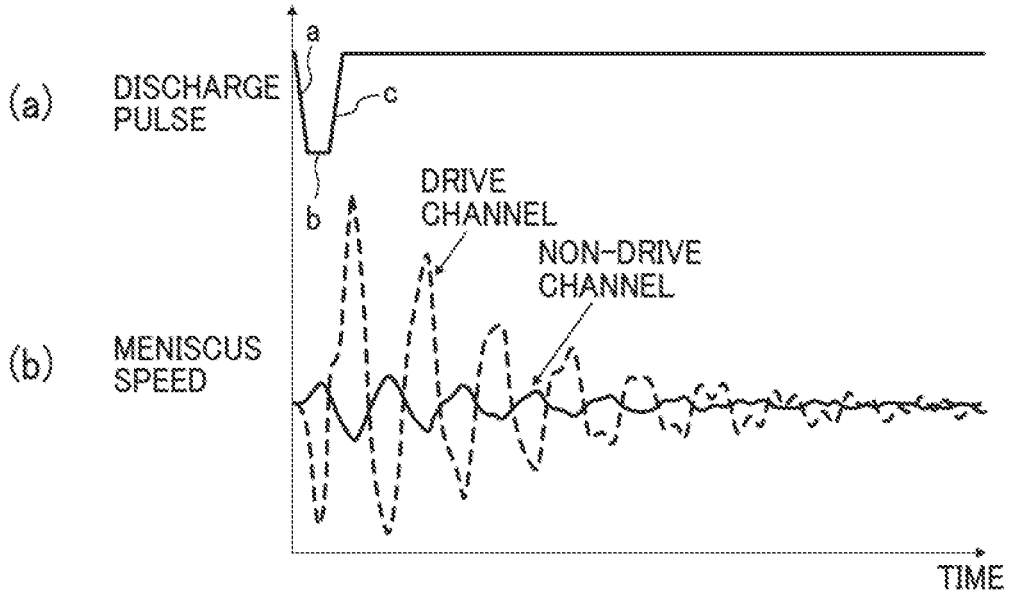
FIG. 11 is a schematic diagram for explaining a meniscus speed of a non-drive channel adjacent to a drive channel in the liquid chamber structure in FIG. 10.

Therefore, as FIG. 11 (*a*) shows, when a drive (discharge) pulse is applied to a pressure generator of a drive individual liquid chamber 106, as FIG. 10 shows, it inflates and a pressure therein decreases (lowers), and an adjacent non-drive individual liquid chamber 106 inflates and a pressure therein increases due to deformations of the channel plate 102 and the nozzle plate 101. When the drive individual liquid chamber 106 contracts and a pressure therein increases, a pressure in the non-drive individual liquid chamber 106 decreases because a capacity thereof returns to the original.

Therefore, as FIG. 11 (*b*) shows, a meniscus oscillation having a phase reverse to that of a meniscus oscillation generated in the drive individual liquid chamber 106 (drive channel) is generated in the non-drive individual liquid chamber 106 (non-drive channel). FIG. 11 (*b*) shows in meniscus speed as well.

Next, an example of relation between a pulse interval and a droplet speed when droplets having different sizes each other are discharged from adjacent nozzles is explained with reference to FIGS. 12 and 13.

Figure 12:
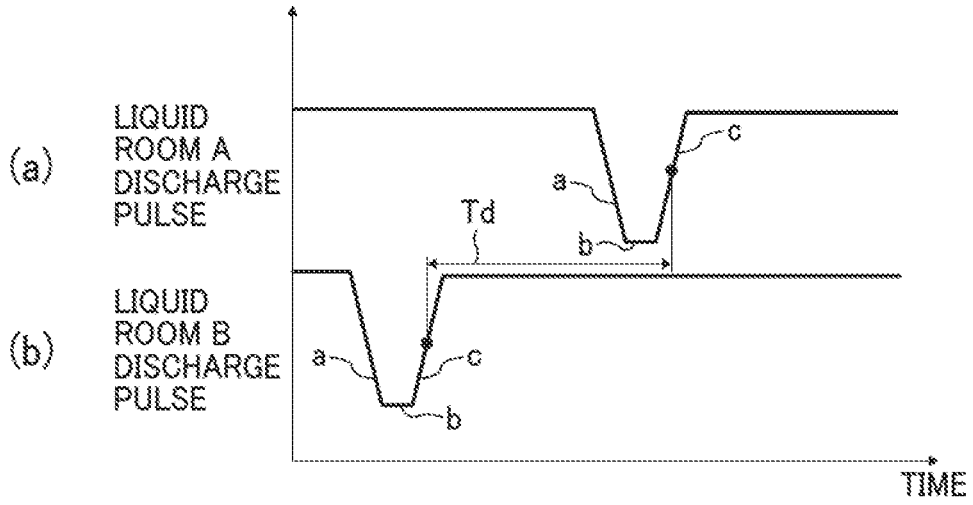
FIG. 12 is a schematic diagram for explaining when channels adjacent to each other in the liquid chamber structure discharge droplets having sizes different from each other, a discharge pulse is applied at a timing shifted by a pulse interval.

As FIG. 12 shows, after a discharge pulse is applied to a pressure generator in an individual liquid chamber B adjacent to an individual liquid chamber A, a discharge pulse is applied to a pressure generator in the individual liquid chamber A. A pulse interval between the discharge pulse applied to the pressure generator in the individual liquid chamber B and the discharge pulse applied to the pressure generator in the individual liquid chamber A is Td.

Figure 13:
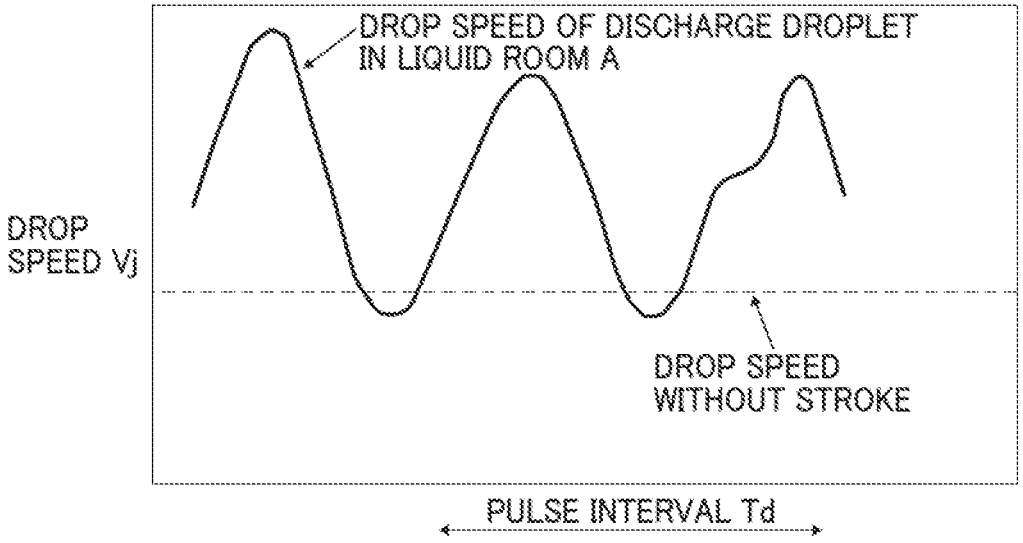
FIG. 13 is a schematic diagram for explaining an example of a change of the drop speed of a droplet discharged from a channel applied with a discharge pulse after a pulse interval Td when the pulse interval Td is changed.

Then, as FIG. 13 shows, the pulse interval Td varies a droplet speed Vj of a droplet discharged from a nozzle of the liquid chamber A. Namely, a crosstalk from the liquid chamber B driven before in time series generates a meniscus oscillation in the chamber A, having a phase reverse to that of a meniscus oscillation in the chamber B to vary the droplet speed Vj of a droplet discharged from a nozzle of the liquid chamber A.

Against the meniscus oscillation generated by crosstalk in the liquid chamber A, a discharge pulse is applied to the pressure generator in the liquid chamber A in a resonance timing area. This makes the droplet speed Vj of a droplet discharged from a nozzle of the liquid chamber A be equivalent to a speed without crosstalk or higher than that to reduce shift of landing position.

Figure 14:
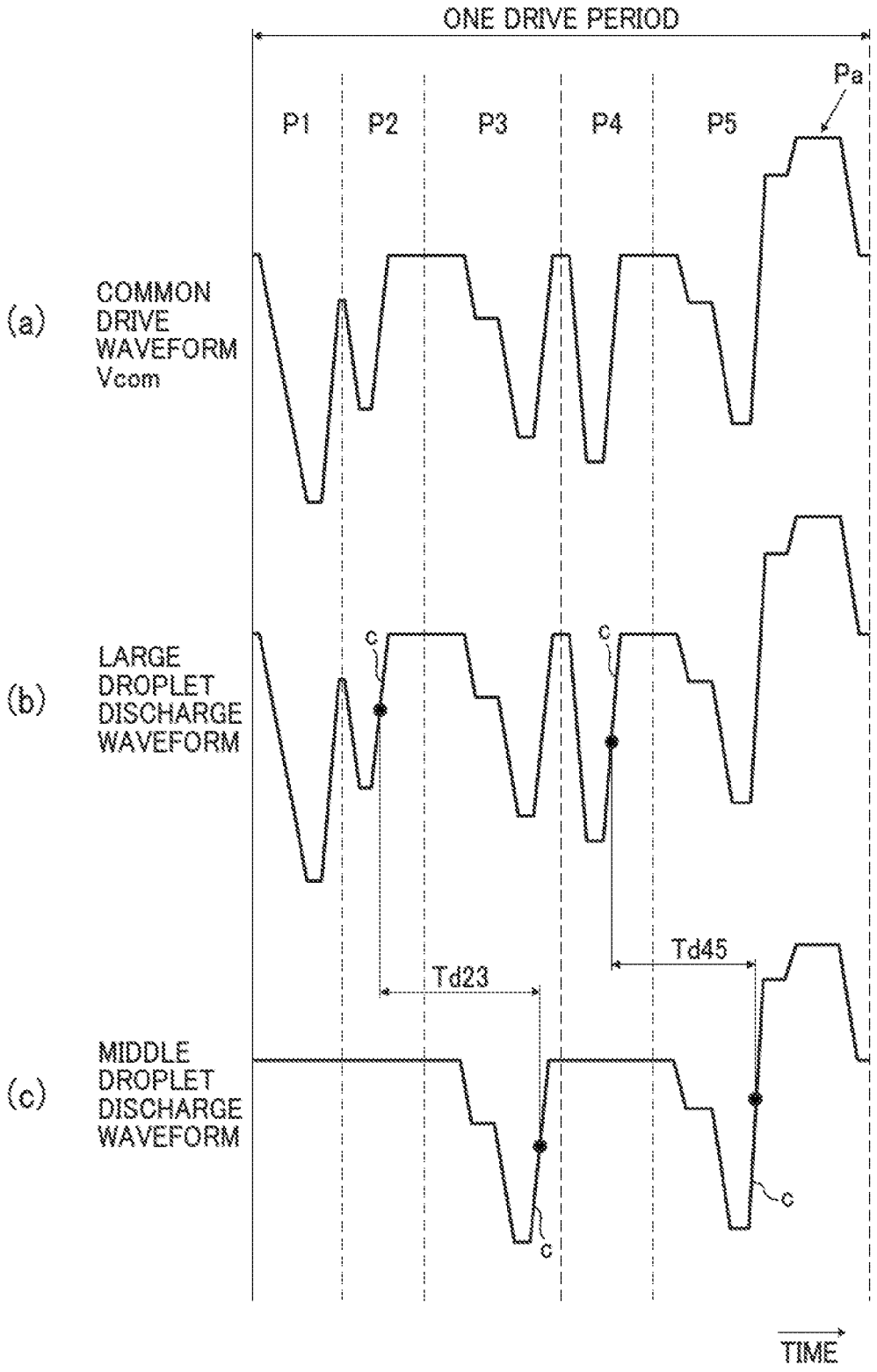
FIG. 14 is a schematic diagram for explaining a common drive waveform, a large droplet discharge drive waveform and a middle droplet discharge drive waveform in a first embodiment of the present invention.

Next, a first embodiment of the present invention is explained with reference to FIG. 14. FIG. 14 is a schematic diagram for explaining a common drive waveform, a large droplet discharge drive waveform and a middle droplet discharge drive waveform in a first embodiment of the present invention.

In this embodiment, a liquid discharge head is a head including a drive individual liquid chamber discharging a droplet and a non-drive individual liquid chamber where a meniscus oscillation having a reverse phase is generated. Namely, an activation from inflation to contraction in the drive individual liquid chamber causes a meniscus oscillation, i.e., from contraction to inflation in the adjacent non-drive individual liquid chamber.

A common drive waveform (common drive signal) Vcom includes, as FIG. 14 (*a*) shows, droplet discharge pulses P1 to P5 in one drive (print) cycle in time series. The discharge pulse P5 includes a residual oscillation suppress waveform Pa.

All of the discharge pulses P1 to P5 basically include an inflation waveform element inflating a capacity of the individual liquid chamber 106, a holding waveform element holding the inflated individual liquid chamber 106 and a contraction waveform element contracting the capacity of the individual liquid chamber 106.

The large droplet discharge drive waveform discharging a large-size droplet (large droplet) is formed, as FIG. 9 (*b*) shows, selecting all the discharge pulses P1 to P5 according to selection signals.

The middle droplet discharge drive waveform discharging a droplet having a size smaller than the large droplet (middle droplet) is formed, as FIG. 9 (*c*) shows, selecting the discharge pulses P3 and P5 according to selection signals.

Therefore, among the discharge pulses P1 to P5 of the common drive waveform Vcom, the discharge pulses P3 and P5 are used for forming (discharging) the large and middle droplets having two different sizes from each other. The discharge pulses P1, P2 and P4 are noncommon discharge pulses which are used only for forming (discharging) the large droplet.

The second discharge pulse P2 of large droplet (noncommon discharge pulse) is located right before the first discharge pulse P3 of middle droplet (common discharge pulse). The fourth discharge pulse P4 of large droplet (noncommon discharge pulse) is located right before the second discharge pulse P5 of middle droplet (common discharge pulse).

The common discharge pulse P3 has a pulse interval Td 23 with the noncommon discharge pulse P2 located right before the discharge pulse P3 in a time area having a phase reverse to that of resonance.

The common discharge pulse P5 has a pulse interval Td 45 with the noncommon discharge pulse P4 located just before the discharge pulse P5 in a time area having a phase reverse to that of resonance.

The pulse interval Td is a time between intermediate points in the contraction process (contraction waveform element c) including discharge in the process of inflation to contraction of the discharge pulse.

Namely, the pulse interval Td 23 between the common discharge pulse P3 and the discharge pulse P2 located right before the common discharge pulse P3 is a relation in which a meniscus oscillation generated by drive of the discharge pulse P2 in a drive individual liquid chamber and a meniscus oscillation generated in a non-drive individual liquid chamber adjacent to the drive individual liquid chamber are in time area of resonance phase.

Similarly, the pulse interval Td 45 between the common discharge pulse P5 and the discharge pulse P4 located right before the common discharge pulse P5 is a relation in which a meniscus oscillation generated by drive of the discharge pulse P4 in a drive individual liquid chamber and a meniscus oscillation generated in a non-drive individual liquid chamber adjacent to the drive individual liquid chamber are in time area of resonance phase.

Thus, the common discharge pulse has a pulse interval with the noncommon discharge pulse located just before the discharge pulse in a time area having a phase reverse to that of resonance.

Another embodiment of the liquid discharge head is explained with reference to FIGS. 15A and 15B, and FIGS. 16A and 16B.

Figure 15A:
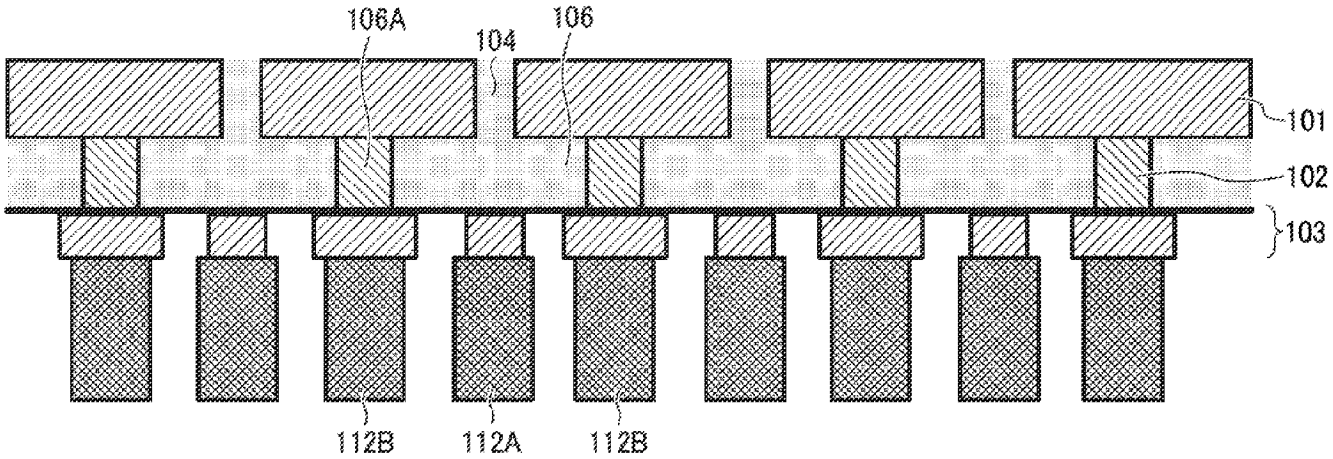
FIGS. 15A and 15B are schematic views illustrating a first example of transformation of the liquid discharge head when driven in the embodiment.
Figure 15B:
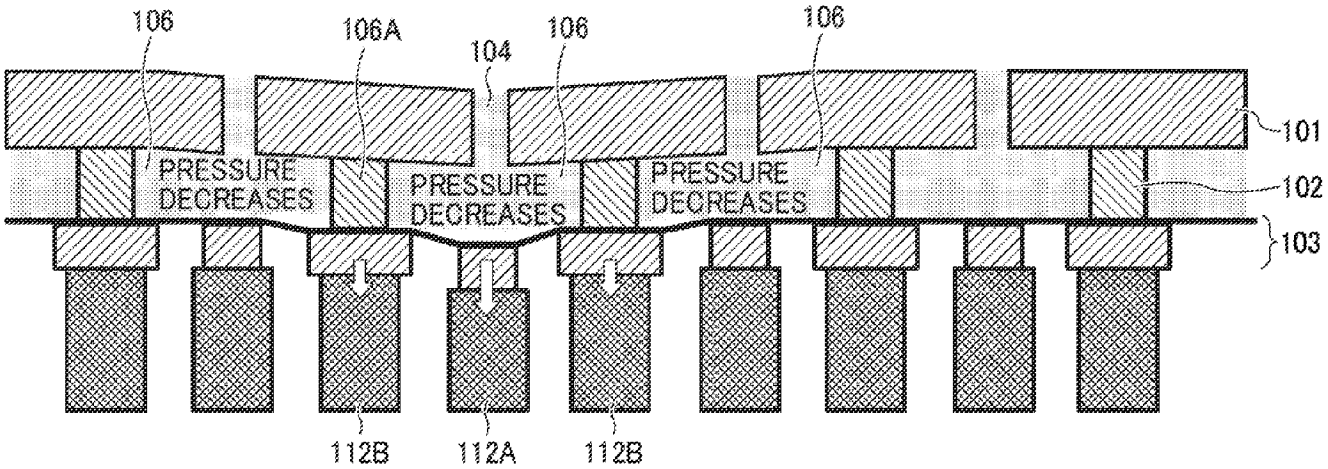
Figure 16A:
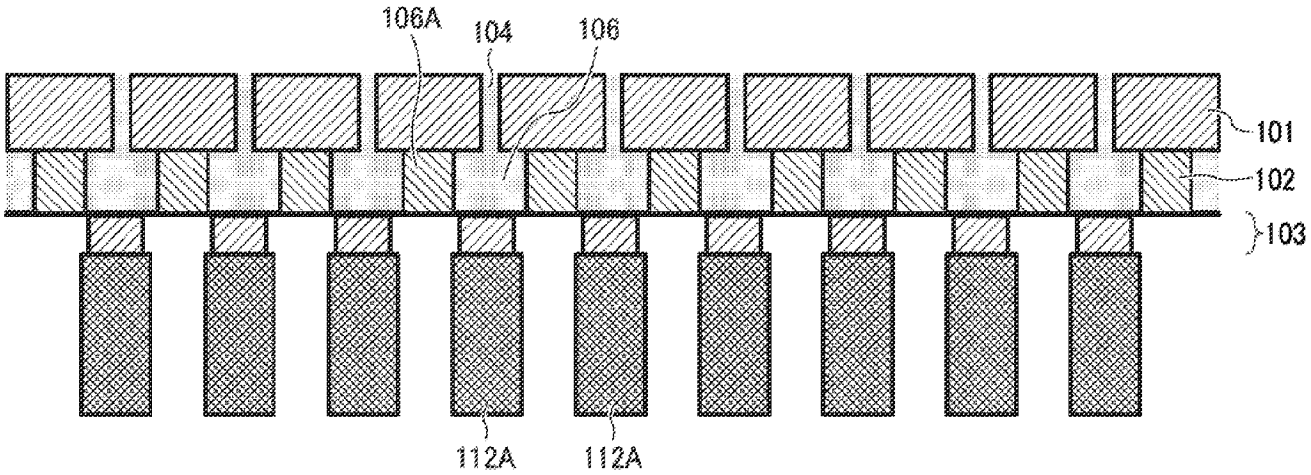
FIGS. 16A and 16B are schematic views illustrating a second example of transformation of the liquid discharge head when driven in the embodiment.
Figure 16B:
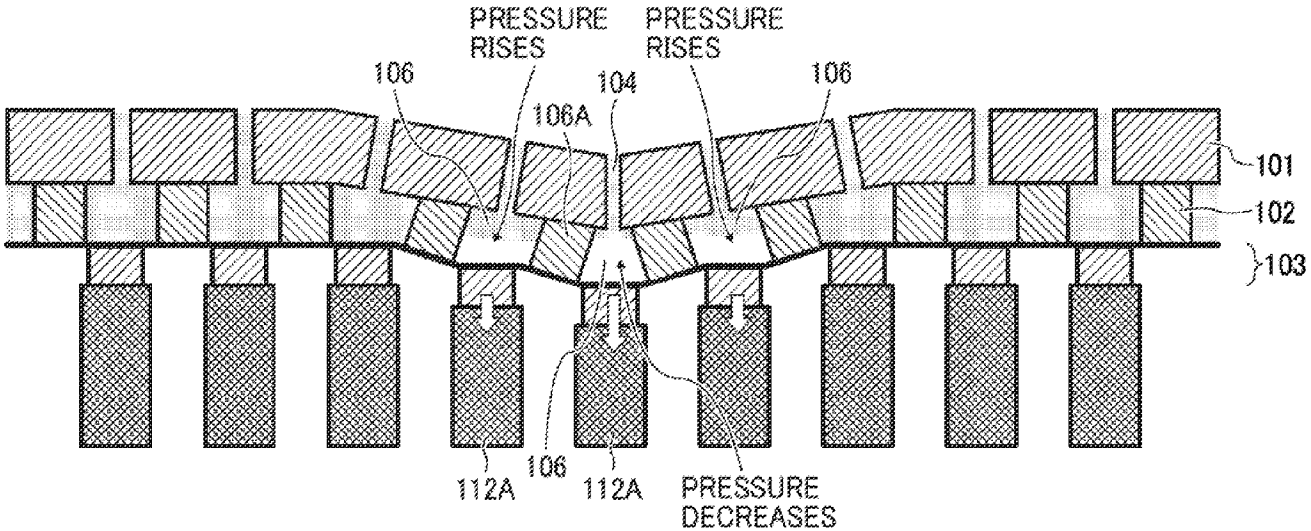

FIGS. 15A and 15B are a head having a high-pitch structure in which through-holes forming individual channels are formed on the channel plate 102. FIGS. 16A and 16B are a head having a normal-pitch structure in which through-holes forming individual channels are formed on the channel plate 102.

As FIGS. 15B and 16B show, when the capacity of a drive individual liquid chamber is inflated to discharge a droplet, channel members including the nozzle plate are deformed. Therefore, a crosstalk contracting a volume of the liquid chamber is generated in an adjacent non-drive individual liquid chamber due to deformation of the nozzle plate.

Namely, a meniscus oscillation generated in the drive individual liquid chamber has a phase reverse to that of a meniscus oscillation generated in the adjacent non-drive individual liquid chamber.

When the meniscus oscillation generated in the drive individual liquid chamber has the same phase as that of the meniscus oscillation generated in the adjacent non-drive individual liquid chamber, the pulse interval Td is in a resonance time area to avoid lowering of discharge speed (droplet speed Vj) due to crosstalk.

However, a head in which a meniscus oscillation generated in the drive individual liquid chamber has a phase reverse to that of a meniscus oscillation generated in the adjacent non-drive individual liquid chamber, even the pulse interval Td in a resonance time area is unable to avoid lowering of discharge speed due to crosstalk.

Therefore, the head in which a meniscus oscillation generated in the drive individual liquid chamber has a phase reverse to that of a meniscus oscillation generated in the adjacent non-drive individual liquid chamber has a pulse interval in a time area having a reverse phase to avoid lowering of discharge speed due to crosstalk.

In this embodiment, continuously selected two noncommon discharge pulses P1 and P2 are located before the common discharge pulse P3. A pulse interval between these two noncommon discharge pulses P1 and P2 is a resonance time area. A pulse interval between the discharge pulses P3 and P4 is a resonance time area as well.

Namely, two noncommon discharge pulses continuously selected in a time (1Tc (resonance frequency)±¼) are located before a common discharge pulse.

A discharge pulse interval used for forming a large droplet is a resonance time area to increase an amplitude of the meniscus oscillation generated by crosstalk in the adjacent individual liquid chamber larger than a meniscus oscillation generated by a single pulse and a meniscus oscillation generated when even two pulses are continuously driven out of the resonance time area. A discharge pulse for forming a large droplet is located in a resonance time to have various advantages in discharging large droplets.

When a drive waveform having plural discharge pulses to discharge a droplet having a large size (continuously applying many discharge pulses), the following problems occur if all the pulse intervals have reverse phase.

Namely, as the effect of resonance is not used, the discharge efficiency is poor at the time area. The discharge pulses have to have a large difference of potential (large inflation and contraction) to obtain a target drop speed Vj.

All droplets need merging before landing on a paper. When there is a usable voltage range, it is difficult to discharge a high-speed droplet capable of catching up with a prior droplets to cause poor merging, resulting in frequent production of stripe images.

Due to variation of frequency of prior droplets when driven at high frequency, the following droplets cannot catch up with the prior droplets to cause poor merging.

Therefore, when the pulse intervals of the discharge pulses discharging plural droplets such as large droplets are all resonance reverse phase, the discharge efficiency largely deteriorates and poor merging occurs.

In time series of the above continuously selected noncommon discharge pulses (continuous resonance noncommon discharge pulses), the last noncommon discharge pulse and the common discharge pulse right after the last noncommon discharge pulse are time areas of resonance reverse phase ($n \times Tc \pm 1/4$) to decrease lowering of discharge speed to an adjacent individual liquid chamber due to crosstalk.

In time series of the continuous resonance noncommon discharge pulses, a common discharge pulse of resonance reverse phase is applied right after the last noncommon discharge pulse to not only reduce crosstalk to an adjacent individual liquid chamber but also control a meniscus oscillation in an individual liquid chamber when driven by the continuous resonance noncommon discharge pulses.

Figure 17:
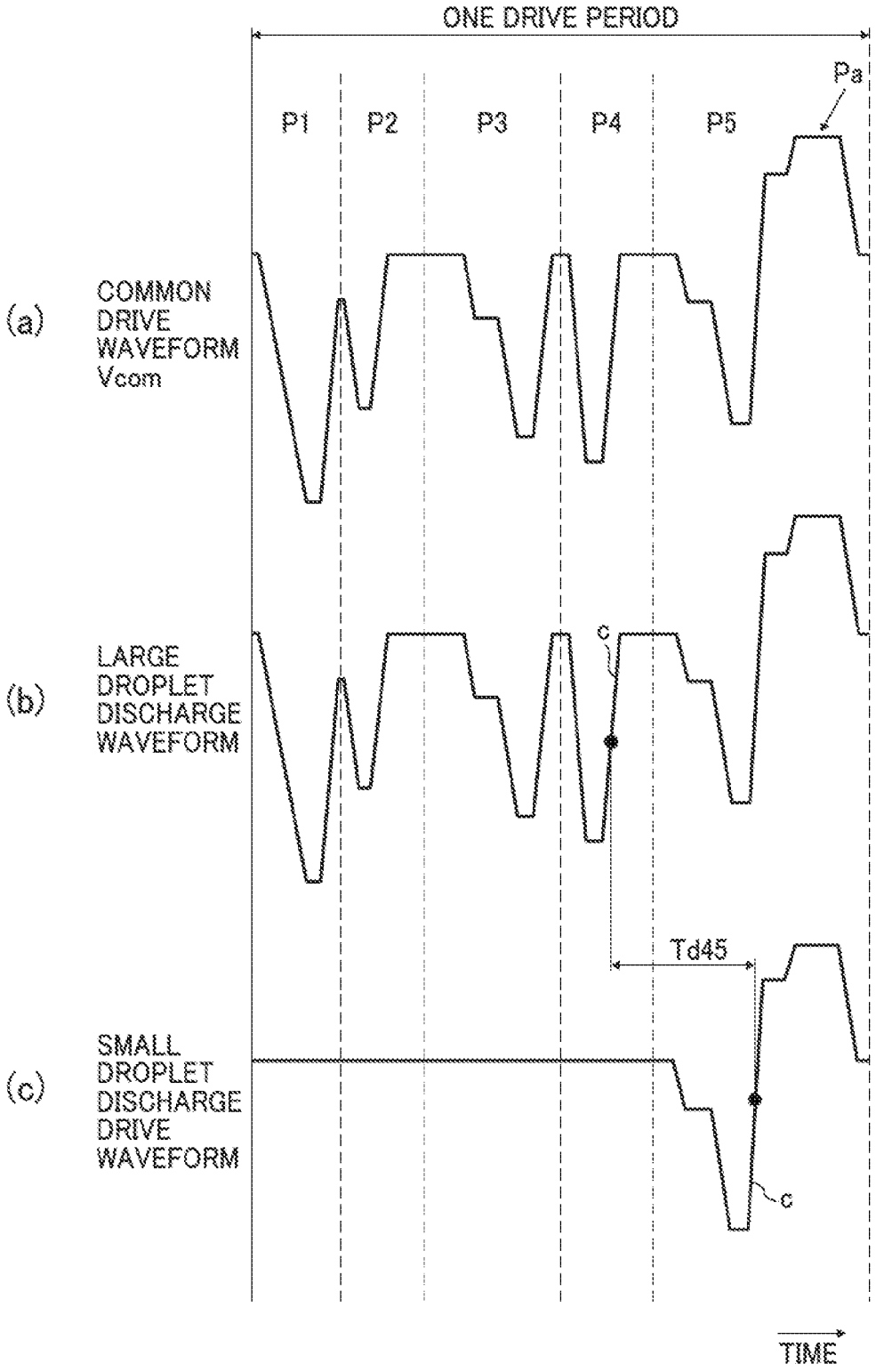
FIG. 17 is a schematic diagram for explaining a common drive waveform, a large droplet discharge drive waveform and a small droplet discharge drive waveform in a second embodiment of the present invention.

Next, a second embodiment of the present invention is explained with reference to FIG. 17. FIG. 17 is a schematic diagram for explaining a common drive waveform, a large droplet discharge drive waveform and a small droplet discharge drive waveform in the second embodiment of the present invention.

A liquid discharge head in the embodiment is, as mentioned above, a head including a drive individual liquid chamber discharging a droplet and a non-drive individual liquid chamber where a meniscus oscillation having a reverse phase is generated. Namely, an activation from inflation to contraction in the drive individual liquid chamber causes a meniscus oscillation, i.e., from contraction to inflation in the adjacent non-drive individual liquid chamber.

A common drive waveform (signal) Vcom includes, as FIG. 17 (*a*) shows, discharge pulses P1 to P5 discharging droplets in time series in one drive (print) cycle. The discharge pulse P5 includes a residual oscillation suppress waveform Pa.

All of the discharge pulses P1 to P5 basically include an inflation waveform element inflating a capacity of the individual liquid chamber 106, a holding waveform element holding the inflated individual liquid chamber 106 and a contraction waveform element contracting the capacity of the individual liquid chamber 106.

The large droplet discharge drive waveform discharging a large-size droplet (large droplet) is formed, as FIG. 17 (*b*) shows, selecting all the discharge pulses P1 to P5 according to selection signals.

The small droplet discharge drive waveform discharging a droplet having a size smaller than the large droplet (small droplet) is formed, as FIG. 17 (*c*) shows, selecting the discharge pulse P5 according to a selection signal.

Therefore, among the discharge pulses P1 to P5 of the common drive waveform Vcom, the discharge pulse P5 is used for forming (discharging) the large and small droplets having two different sizes from each other. The discharge pulses P1 to P4 are noncommon discharge pulses which are used only for forming (discharging) the large droplet.

The fourth discharge pulse P4 of large droplet (noncommon discharge pulse) is located right before the discharge pulse P5 of small droplet (common discharge pulse). The common discharge pulse P5 has a pulse interval Td 45 with the noncommon discharge pulse P4 located just before the discharge pulse P5 in a time area having a phase reverse to that of resonance.

Similarly to the first embodiment, even a head in which a meniscus oscillation generated in the drive individual liquid chamber has a phase reverse to that of a meniscus oscillation generated in the adjacent non-drive individual liquid chamber has a pulse interval in a time area having a reverse phase to avoid lowering of discharge speed due to crosstalk.

Figure 18:
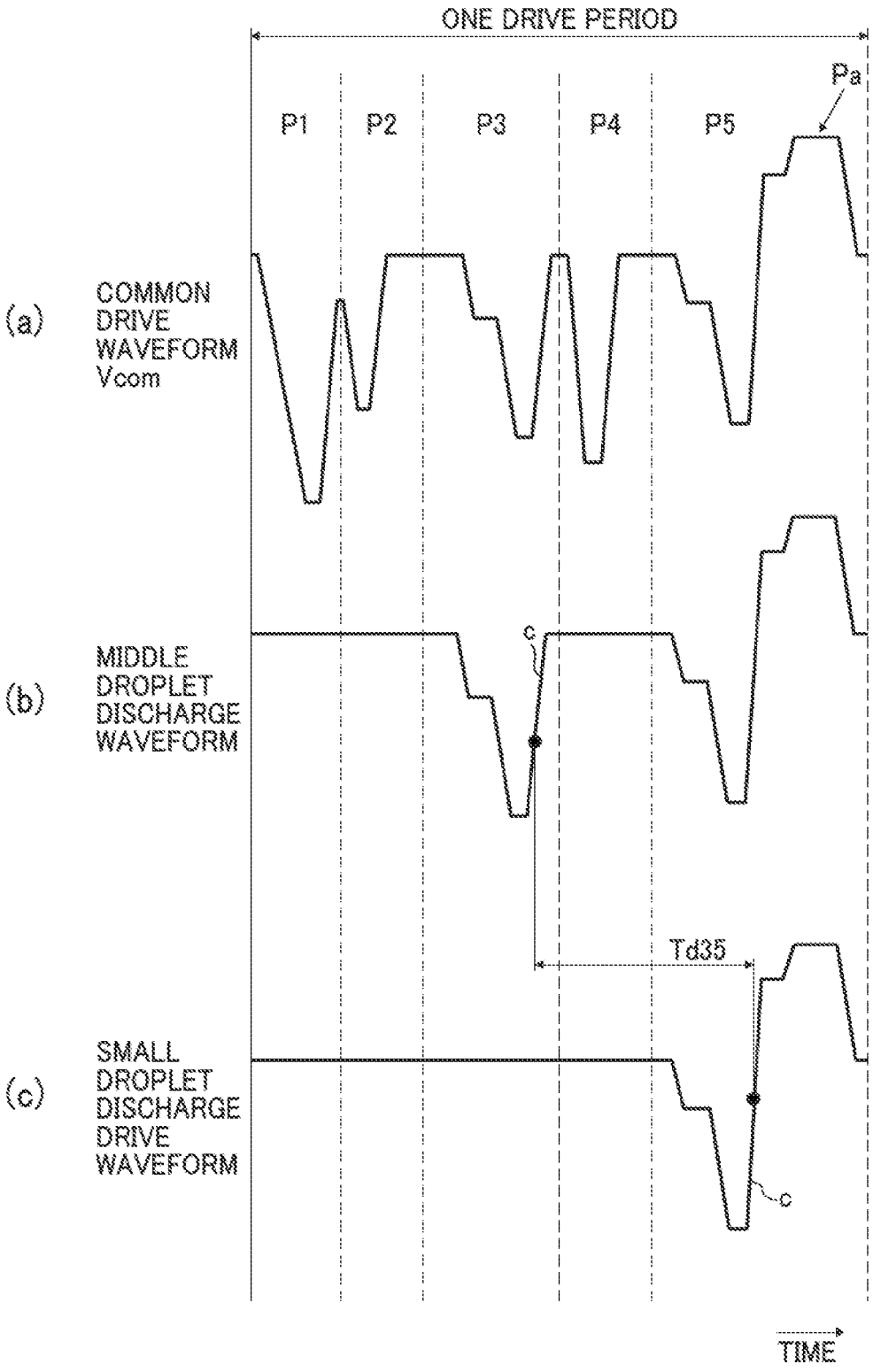
FIG. 18 is a schematic diagram for explaining a common drive waveform, a middle droplet discharge drive waveform and a small droplet discharge drive waveform in a third embodiment of the present invention.

Next, a third embodiment of the present invention is explained with reference to FIG. 18. FIG. 18 is a schematic diagram for explaining a common drive waveform, a middle droplet discharge drive waveform and a small droplet discharge drive waveform in the third embodiment of the present invention.

A liquid discharge head in the embodiment is, as mentioned above, a head including a drive individual liquid chamber discharging a droplet and a non-drive individual liquid chamber where a meniscus oscillation having a reverse phase is generated. Namely, an activation from inflation to contraction in the drive individual liquid chamber causes a meniscus oscillation, i.e., from contraction to inflation in the adjacent non-drive individual liquid chamber.

A common drive waveform (signal) Vcom includes, as FIG. 18 (*a*) shows, discharge pulses P1 to P5 discharging droplets in time series in one drive (print) cycle. The discharge pulse P5 includes a residual oscillation suppress waveform Pa.

All of the discharge pulses P1 to P5 basically include an inflation waveform element inflating a capacity of the individual liquid chamber 106, a holding waveform element holding the inflated individual liquid chamber 106 and a contraction waveform element contracting the capacity of the individual liquid chamber 106.

The large droplet discharge drive waveform discharging a large-size droplet (middle droplet) is formed, as FIG. 18 (*b*) shows, selecting all the discharge pulses P3 and P5 according to selection signals.

The small droplet discharge drive waveform discharging a droplet having a size smaller than the middle droplet (small droplet) is formed, as FIG. 18 (*c*) shows, selecting the discharge pulse P5 according to a selection signal.

Therefore, between the discharge pulses P3 and P5 of the common drive waveform Vcom, the discharge pulse P5 is used for forming (discharging) the middle and small droplets having two different sizes from each other. The discharge pulse P3 is a noncommon discharge pulse which is used only for forming (discharging) the middle droplet.

The first discharge pulse P3 of middle droplet (noncommon discharge pulse) is located right before the discharge pulse P5 of small droplet (common discharge pulse).

The common discharge pulse P5 has a pulse interval Td 35 with the noncommon discharge pulse P3 located just before the discharge pulse P5 in a time area having a phase reverse to that of resonance.

Similarly to the first embodiment, even a head in which a meniscus oscillation generated in the drive individual liquid chamber has a phase reverse to that of a meniscus oscillation generated in the adjacent non-drive individual liquid chamber has a pulse interval in a time area having a reverse phase to avoid lowering of discharge speed due to crosstalk.

In the present invention, a sheet, a medium to be recorded, a recording medium, a recording paper and a recording sheet are the same, and image forming, recording, character printing, transfer printing and press printing are the same.

The image forming apparatus discharges a liquid on a medium to form an image thereon.

The image formation includes not only imparting images having meanings such as letters and figures but also imparting images having no meaning such as patterns (simply landing a droplet on a medium).

The image is not limited to plane images, and includes images imparted to a sterically-formed matter and three-dimensionally formed images.

The image forming apparatus includes both of serial-type and line-type image forming apparatuses unless particularly limited.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

a liquid discharge head including:

plural nozzles to discharge droplets;

a plurality of individual liquid chambers provided for respective ones of the plural nozzles, each liquid chamber being communicated with a corresponding nozzle amongst the plural nozzles;

a pressure generator to generate a pressure pressurizing a liquid in each one of the individual liquid chambers, and a head drive controller to chronologically in one drive cycle, generate a common drive waveform including plural discharge pulses for causing droplet discharge, select one or more discharge pulses out of the plural discharge pulses, and apply the selected discharge pulses to the pressure generator to discharge at least two droplets having different sizes, wherein a meniscus oscillation generated in a drive individual liquid chamber applied with the pressure by the pressure generator has a phase reverse to a phase of a meniscus oscillation generated in an adjacent non-drive individual liquid chamber not applied with the pressure by the pressure generator, the common drive waveform generated by the head drive controller includes a common discharge pulse used for forming droplets having at least two sizes and an noncommon discharge pulse used for forming one of the droplets having two sizes, and a pulse interval between the common discharge pulse and the noncommon discharge pulse located right before the common discharge pulse is a time area having a phase reverse to resonance.

2. The image forming apparatus of claim 1, wherein each of the common discharge pulse and the noncommon discharge pulse includes a contraction waveform element to cause the individual liquid chamber to transition from being inflated to being contacted to discharge the droplet, and the pulse interval is a time between each of the contraction waveform elements.

3. The image forming apparatus of claim 1, wherein the liquid discharge head further includes:

a nozzle plate to from the nozzle;

a channel plate to form the individual liquid chamber; and a wall member to form a wall of the individual liquid chamber, wherein the channel plate includes a through-hole to form the individual liquid chamber.

4. The image forming apparatus of claim 1, wherein two of the noncommon discharge pulses continuously selected within a time (1Tc±¼) are located before the common discharge pulse, and Tc denotes a resonance frequency.

5. A head drive control method of driving a liquid discharge head in an image forming apparatus, the liquid discharge head comprising:

plural nozzles to discharge droplets;

a plurality of individual liquid chambers provided for respective ones of the plurality of nozzles, each liquid chamber being communicated with a corresponding nozzle amongst the plural nozzles; and a pressure generator to generate a pressure pressurizing a liquid in each one of the individual chambers, wherein a meniscus oscillation generated in a drive individual liquid chamber applied with the pressure by the pressure generator has a phase reverse to a phase of a meniscus oscillation generated in an adjacent non-drive individual liquid chamber not applied with the pressure by the pressure generator, the method comprising:

generating a common drive waveform including plural discharge pulses for causing droplet discharge chronologically in one drive cycle; and selecting one or more discharge pulses out of the plural discharge pulses to be applied to the pressure generator to discharge droplets having at least two different sizes, wherein the common drive waveform includes at least a common discharge pulse used for forming the droplets having two sizes and a noncommon discharge pulse used for forming one of the droplets having two sizes, and a pulse interval between the common discharge pulse and the noncommon discharge pulse located right before the common discharge pulse is a time area having a phase reverse to resonance.

6. The image forming apparatus of claim 1, wherein in the pulse interval, the meniscus oscillation generated in the drive individual liquid chamber applied with the pressure by the pressure generator in response to the noncommon discharge pulse and the meniscus oscillation meniscus oscillation generated in the adjacent non-drive individual liquid chamber not applied with the pressure by the pressure generator in response to the noncommon discharge pulse are in a time area of resonance phase.

* * * * *